US008186808B2

(12) United States Patent
Lee et al.

(10) Patent No.: US 8,186,808 B2
(45) Date of Patent: May 29, 2012

(54) DROPLET JETTING APPARATUS USING ELECTROSTATIC FORCE AND MANUFACTURING METHOD AND INK PROVIDING METHOD THEREOF

(75) Inventors: Sukhan Lee, Gyeonggi-do (KR); Young Min Kim, Gyeonggi-do (KR); Sang Uk Son, Gyeonggi-do (KR); Jae Yong Choi, Seoul (KR); Do Young Byun, Seoul (KR)

(73) Assignee: Sungkyunkwan University Foundation for Corporate Collaboration, Gyeonggi-Do (KR)

( * ) Notice: Subject to any disclaimer, the term of this patent is extended or adjusted under 35 U.S.C. 154(b) by 1133 days.

(21) Appl. No.: 12/032,498

(22) Filed: Feb. 15, 2008

(65) Prior Publication Data

US 2009/0189956 A1 Jul. 30, 2009

(30) Foreign Application Priority Data

Jan. 25, 2008 (KR) ..... 10-2008-0008100

(51) Int. Cl.
*B41J 2/06* (2006.01)

(52) U.S. Cl. ..... 347/55; 347/47; 347/44

(58) Field of Classification Search ..... 347/55, 347/47, 44

See application file for complete search history.

(56) References Cited

U.S. PATENT DOCUMENTS 3,700,169 A * 10/1972 Naydan et al. ..... 239/4
3,941,312 A * 3/1976 Ohno et al. ..... 239/696
4,555,717 A * 11/1985 Miura et al. ..... 347/21
4,684,957 A * 8/1987 Miura et al. ..... 347/55
4,736,212 A * 4/1988 Oda et al. ..... 347/55
4,801,954 A * 1/1989 Miura et al. ..... 347/21
4,801,955 A * 1/1989 Miura et al. ..... 347/55
4,829,325 A * 5/1989 Iwasawa et al. ..... 347/55
4,975,718 A * 12/1990 Akami et al. ..... 347/55
5,278,583 A * 1/1994 Oda et al. ..... 347/55
2007/0101934 A1* 5/2007 Nishio et al. ..... 118/629

FOREIGN PATENT DOCUMENTS

JP 2006-239985 9/2006
KR 2001-0045309 6/2001

* cited by examiner

*Primary Examiner* — Matthew Luu
*Assistant Examiner* — Henok Legesse
(74) *Attorney, Agent, or Firm* — Rabin & Berdo, P.C.

(57) ABSTRACT

The present invention relates to a droplet jetting apparatus using electrostatic force, a manufacturing method thereof and an ink providing method thereof. The droplet jetting apparatus using electrostatic force includes a lower electrode unit in which a nozzle and a lower electrode positioned in the nozzle equipped in the upper part of a first substrate, and an ink inflow channel equipped in the lower part of the first substrate are integrally formed; an upper electrode unit having an upper electrode formed on the top surface of a second substrate and an ink discharge hole formed by being penetrated to the upper electrode from the bottom surface of the second substrate; and a bonding layer for bonding the lower electrode unit and the upper electrode unit with each other so that the nozzle is vertically aligned with the ink discharge hole. According to this configuration, the ink used in the droplet jetting apparatus is easy to select, the electrostatic force can be efficiently concentrated and manufacturing processes of the droplet jetting apparatus can be simplified.

6 Claims, 10 Drawing Sheets

DROPLET JETTING APPARATUS USING ELECTROSTATIC FORCE AND MANUFACTURING METHOD AND INK PROVIDING METHOD THEREOF

The present application claims priority under 35 U.S.C. 119 to Korean Patent Application No. 10-2008-0008100 (filed on Jan. 25, 2008), which is hereby incorporated by reference in its entirety.

TECHNICAL FIELD

The present invention relates to a droplet jetting apparatus using electrostatic force and, more particularly, to a droplet jetting apparatus to which MEMS (Microelectro Mechanical System) technology and semiconductor manufacturing processes are applied using semiconductor substrates.

BACKGROUND

A droplet jetting apparatus used in a known inkjet print head squirts a small amount of ink to the outside through a nozzle by heating a heater or applying physical force such as pressure by a piezoelectric element or electrostatic force to an ink chamber in which ink is stored. The droplet jetting apparatus is classified into a heating type, a piezoelectric type, a thermal compress type, and an electrostatic force type according to how the physical forces are applied to the ink.

Among the droplet jetting apparatuses of the various types, the thermal compress type droplet jetting apparatus is shown in FIG. 10. As shown in the figure, conventional droplet jetting apparatus of thermal compress type is constituted of a driving unit 20, a membrane 30 and a nozzle unit 40.

The driving unit 20 includes an oxide film 14 laminated on a substrate 15, a working fluid barrier 25 having a working fluid chamber 27, a heater 16 interposed in the working fluid chamber 27 and a wire 17 connected to the heater 16.

The nozzle unit 40 includes an ink chamber barrier 45 having an ink chamber 57 and a nozzle plate 47 connected to the top of the ink chamber barrier 45. A nozzle hole 49 for jetting the ink in the ink chamber 57 is formed on the top surface of the nozzle plate 47.

The membrane 30 is interposed between the ink chamber barrier 45 and the working fluid barrier 25 to partition the working fluid chamber 27 and the ink chamber 57.

In this configuration, the working fluid chamber 27 is charged with the working fluid such as heptane and the ink is continuously supplied to the ink chamber 57 from an ink supply source not shown.

When a current is supplied to the heater 16 through the wire 17, the heater 16 generates heat and the working fluid in the working fluid chamber 27 is heated by the heat, thereby generating bubbles. The internal pressure of the working fluid chamber 27 is increased by the bubbles and the membrane 30 is curved upward. As a result, the inside of the ink chamber 57 is pressurized and the ink is discharged through the nozzle hole 49.

In this state, when the current supply to the heater 16 is stopped, the bubbles are condensed. Accordingly, the membrane 30 is restored and the pressure in the ink chamber 57 lowers. At this time, an ink droplet is exposed outside the ink chamber 57 while the ink exposed to the outside through the nozzle hole 49 is cut off. As the heating operation of the heater 16 is repeated in the above-mentioned manner, the ink is discharged.

However, in the above-mentioned conventional droplet jetting apparatus, the ink can be discharged in the nozzle hole by the bubbles of the working fluid generated by the heat of the heater, and thus color denaturation of the ink could be incurred due to the heat. Further, since separate manufacturing processes for forming the heater, the working fluid barrier and the membrane are required, and each of the constituent members including the nozzle hole, the ink chamber and the like are formed individually, the manufacturing process is also not easy.

SUMMARY

The present invention has been proposed in order to overcome the above-mentioned problems. Therefore, the primary object of the present invention is to provide a droplet jetting apparatus in which ink is easy to select since a heater is not required and the use of color invariable ink is not required by jetting ink using electrostatic force generated by the potential difference between an upper electrode and a lower electrode.

Another object of the present invention is to provide a droplet jetting apparatus using electrostatic force of which the manufacturing process is simple by fabricating a nozzle for jetting the ink integrally to a lower electrode unit and the electrostatic force can be effectively concentrated by forming the pole-type lower electrode higher than the nozzle in the nozzle of the lower electrode unit, and a manufacturing method of the droplet jetting apparatus.

It is another object of the present invention to provide an ink providing method of the droplet jetting apparatus using the electrostatic force, which can supply the ink by arbitrarily adjusting the size of the ink droplet and the discharge speed of the same.

In accordance with a first aspect of the present invention, a droplet jetting apparatus using electrostatic force includes a lower electrode unit in which a nozzle and a lower electrode positioned in the nozzle equipped in the upper part of a first substrate, and an ink inflow channel equipped in the lower part of the first substrate are integrally formed; an upper electrode unit having an upper electrode formed on the top surface of a second substrate and an ink discharge hole formed by being penetrated to the upper electrode from the bottom surface of the second substrate; and a bonding layer for bonding the lower electrode unit and the upper electrode unit with each other so that the nozzle is vertically aligned with the ink discharge hole. When the electrostatic force generated by the potential difference between the lower electrode and the upper electrode is applied to ink supplied to the nozzle through the ink inflow channel, a meniscus is formed on the end of the nozzle and micro drops of ink are discharged from the edge of the meniscus through the ink discharge hole of the upper electrode unit.

In the droplet jetting apparatus, the ink inflow channel and the nozzle of the lower electrode unit are vertically communicated with each other from the bottom surface to the top surface of the first substrate, and the lower electrode is formed in the nozzle in a pole type. The nozzle of the lower electrode unit is formed on the first substrate in a cylindrical shape of a predetermined height having a nozzle hole and the nozzle hole penetrates vertically to the end of the nozzle from the ink inflow channel. Meanwhile, the pole-type electrode of the lower electrode unit is preferably formed higher than the nozzle and the end of the pole-type electrode of the lower electrode unit may be formed in an acuminate shape.

In accordance with a second aspect of the present invention, there is provided an ink providing method of the droplet jetting apparatus using electrostatic force in which the size and discharge speed of the ink droplet supplied from the end of the nozzle is controlled by adjusting power applied from a power supply source connected to the lower electrode unit and the upper electrode unit in the droplet jetting apparatus.

In accordance with a third aspect of the present invention, there is provided a manufacturing method of the droplet jetting apparatus using electrostatic force including the steps of: (a) forming a lower electrode unit by integrally forming a nozzle and a pole-type lower electrode in the nozzle in the upper part of a first substrate and an ink inflow channel from an external ink supply source in the lower part of the first substrate; (b) forming an upper electrode unit by forming an upper electrode by depositing a metallic film on the top surface of a second substrate and an ink discharge hole penetrating to the upper electrode from the bottom surface of the second substrate; and (c) forming a bonding layer for bonding the lower electrode unit and the upper electrode unit with each other so that the nozzle is vertically aligned with the ink discharge hole.

DRAWINGS

DESCRIPTION

Hereinafter, preferred embodiments of the present invention will be described in detail with reference to the accompanying drawings.

Figure 1:
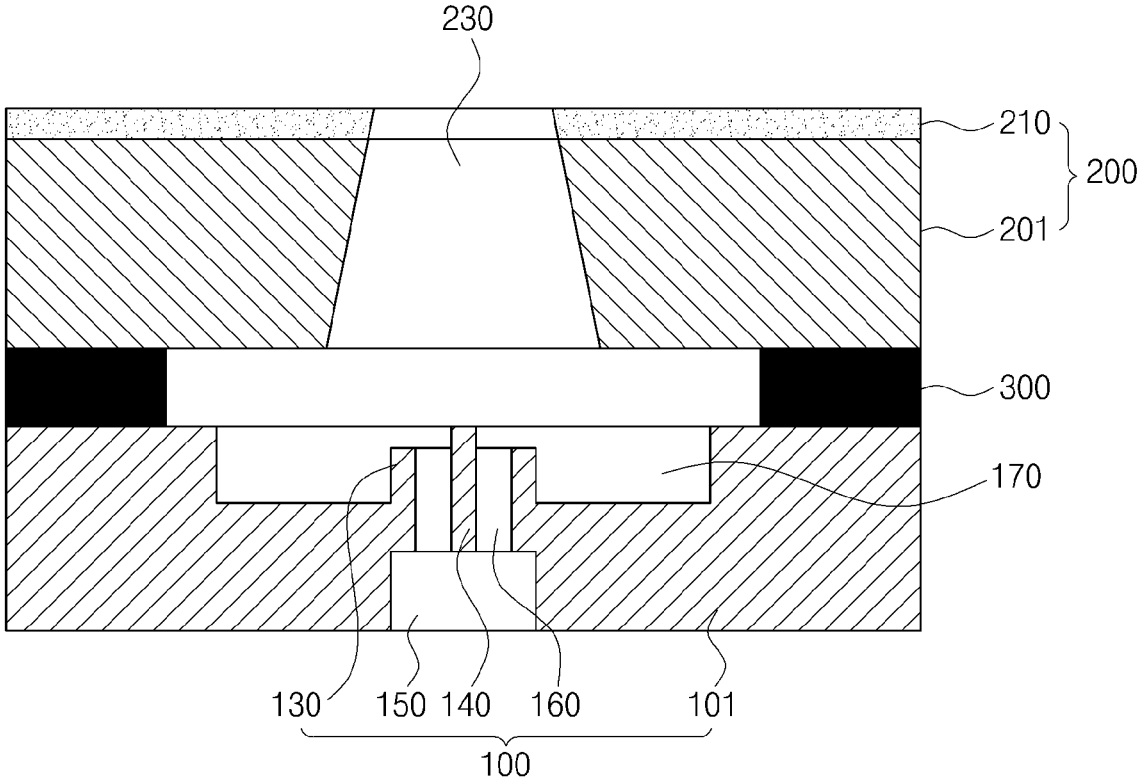
FIG. 1 is a cross-sectional view showing a structure of a droplet jetting apparatus using electrostatic force in accordance with an embodiment of the present invention.

FIG. 1 shows a section structure of a droplet jetting apparatus using electrostatic force in accordance with a preferred embodiment of the present invention. As shown in the figure, the droplet jetting apparatus using electrostatic force of the present invention includes a lower electrode unit 100, an upper electrode unit 200 and a bonding layer 300 for bonding the lower electrode unit and the upper electrode unit. The lower electrode unit and the upper electrode unit are constituted of a wafer or a semiconductor substrate.

More specifically, the lower electrode unit 100 is constituted of a nozzle 130 equipped on the upper part of a first substrate 101, a lower electrode 140 positioned inside of the nozzle and an ink inflow channel 150 equipped in the lower part of the first substrate 101. A chamber hole 170 is formed in the circumference of the nozzle 130 in the upper part of the first substrate. The nozzle 130 is formed in the upper part of the first substrate 101 in a cylindrical shape having a predetermined height and the pole-type lower electrode 140 is integrally formed in the nozzle 130. The ink inflow channel 150 connected to an external ink supply source is formed in the lower part of the first substrate 101 and is equipped with a support member (not shown) for supporting the pole-type lower electrode 140 therein.

The ink inflow channel 150 and the nozzle 130 are vertically communicated with each other from the bottom surface to the top surface of the first substrate 101. That is, a nozzle hole 160 extends to the top surface of the first substrate 101 from the bottom surface of the first substrate 101 in which the ink inflow channel 150 is disposed. Meanwhile, it is desirable to form the pole-type lower electrode 140 higher than the nozzle 130 so as to concentrate the electrostatic force. The concentration efficiency of the electrostatic force can be further improved by sharpening the end of the pole-type lower electrode formed by the above-mentioned configuration.

The upper electrode unit 200 includes an upper electrode 210 formed on the top surface of a second substrate 201 and an ink discharge hole 230 penetrating to the upper electrode from the bottom surface of the second substrate.

The bonding layer 300 is formed by bonding the lower electrode unit 100 and the upper electrode unit 200 with each other by a semiconductor bonding technology. The bonding layer 300 has a thickness that makes the gap between the lower electrode 140 and the upper electrode 210 suitable for discharging ink by the electrostatic force generated between the lower and upper electrodes 140 and 210. At this time, the lower electrode unit 100 and the upper electrode unit 200 are bonded with each other so that the nozzle 130 of the lower electrode unit and the ink discharge hole 230 are vertically aligned.

Figure 2:
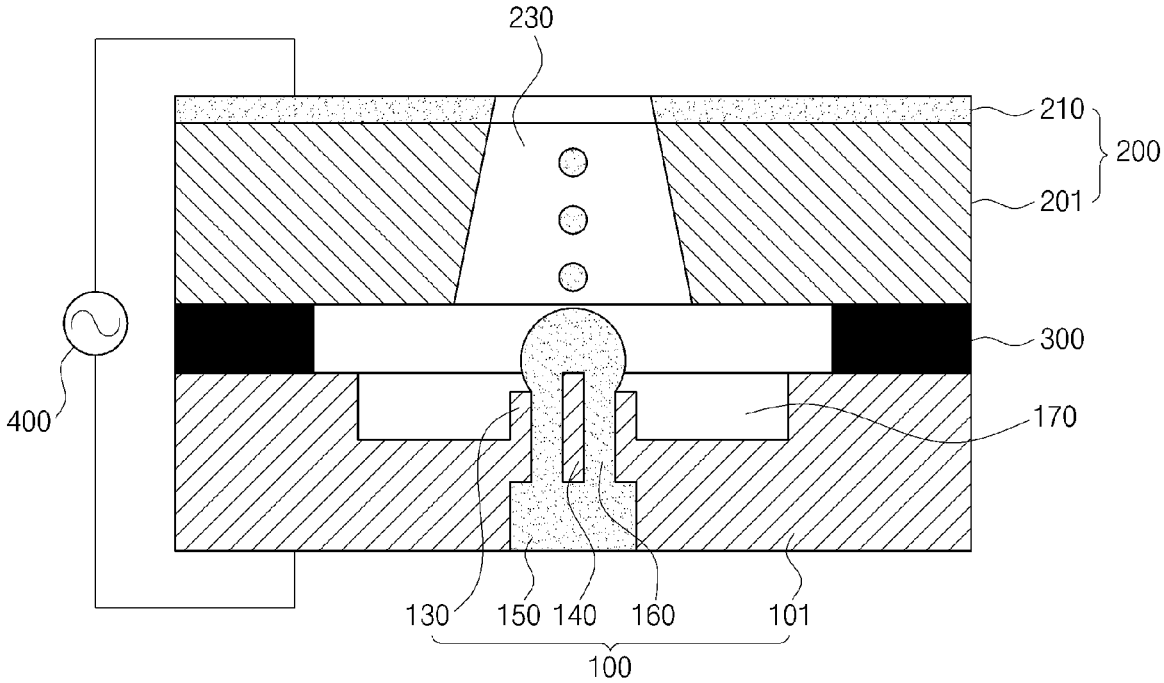
FIG. 2 is a diagram showing a jetting operation of ink by the droplet jetting apparatus using electrostatic force in accordance with the present invention.
Figure 3A:
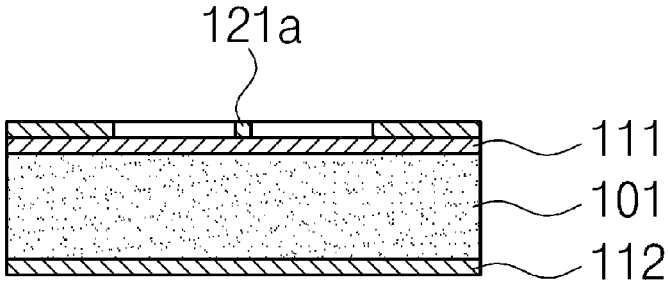
FIGS. 3 to 5 are cross-sectional views showing a forming process of a lower electrode unit in a manufacturing method of the droplet jetting apparatus using electrostatic force in accordance with one embodiment of the present invention.
Figure 3B:
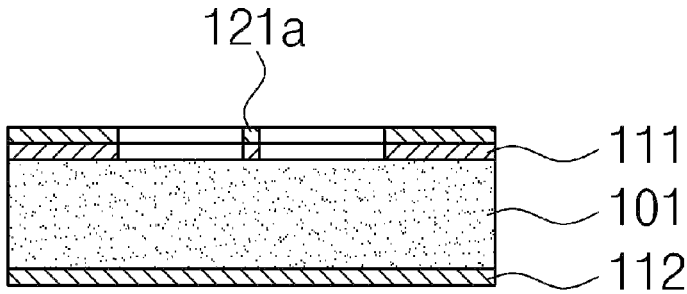
Figure 3C:
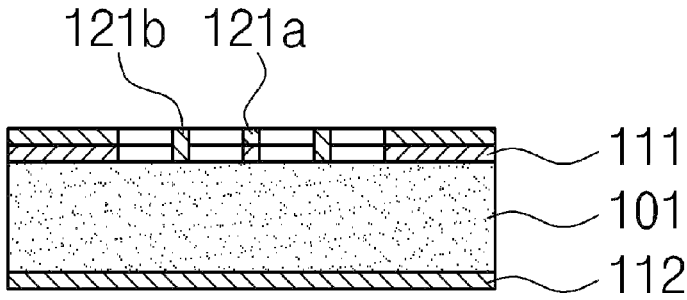
Figure 3D:
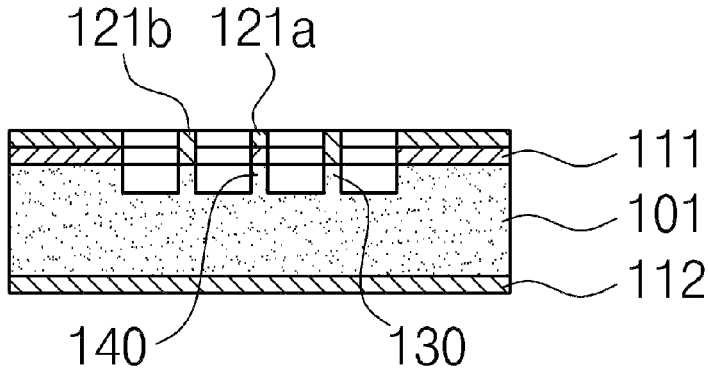

FIG. 2 shows a jetting operation of the ink by the droplet jetting apparatus of the present invention. As shown in the figure, when a predetermined voltage is applied from a power supply unit 400 connected to the lower electrode unit 100 and the upper electrode unit 200 and the electrostatic force generated by a potential difference between the lower electrode 140 and the upper electrode 210 acts on ink supplied to the nozzle hole 160 through the ink inflow channel 150, a meniscus is formed on the end of the nozzle and micro drops of ink are discharged from the edge of the meniscus through the ink discharge hole 230 of the upper electrode unit. At this time, the intensity of the electrostatic force generated by the potential difference between the lower electrode and the upper electrode is changed according to the power applied from the power supply unit 400. Accordingly, for example, a size and a discharge speed of the ink droplet supplied from the end of the nozzle can be adjusted and supplied by adjusting the intensity and the frequency of the voltage applied to the droplet jetting apparatus.

FIGS. 3 to 6 are cross-sectional views showing a configuration of the droplet jetting apparatus sequentially formed according to steps for describing a manufacturing method of the droplet jetting apparatus using electrostatic force in accordance with the present invention.

The method of manufacturing the droplet jetting apparatus in accordance with the present invention includes a step of forming a lower electrode unit 100 of integrally forming the nozzle 130 and the pole-type lower electrode 140 in the nozzle in the upper part of the first substrate 101, and the ink inflow channel 150 in the lower part of the first substrate 101; a step of forming an upper electrode unit 200 of forming the upper electrode 210 by depositing a metallic film on the top surface of the second substrate 201 and the ink discharge hole 230 penetrating to the upper electrode 210 from the bottom surface of the second substrate 201; and a step of forming a bonding layer 300 of bonding the lower electrode unit and the upper electrode unit with each other so that the nozzle 130 and the ink discharge hole 230 are vertically aligned.

The step of forming the lower electrode unit in accordance with a first embodiment of the present invention will be described with reference to FIGS. 3 to 5.

FIGS. 3(*a*) to 3(*d*) show the process of forming the nozzle and the pole-type lower electrode in the upper part of the first substrate in the lower electrode unit forming step.

First, after a photosensitive polymer layer 121*a* such as a photoresistor layer is formed to a predetermined thickness in a central part of the top surface of the first substrate 101 on which oxide films 111 and 112 are formed by the use of semiconductor processing equipments, the pole-type lower electrode 140 is patterned by using a photo engraving process (see FIG. 3(*a*)). The oxide film 111 formed on the top surface of the first substrate is etched by wet etching or dry etching (see FIG. 3(*b*)).

After then, a photosensitive polymer layer 121*b* such as a photoresistor layer is formed to a predetermined thickness in the part where the oxide film on the top surface of the first substrate is removed and the nozzle is patterned by using a photo engraving process. (see FIG. 3(*c*)). The nozzle 130 and the pole-type lower electrode 140 are simultaneously formed by etching the upper part of the first substrate by dry etching (see FIG. 3(*d*)).

Figure 4A:
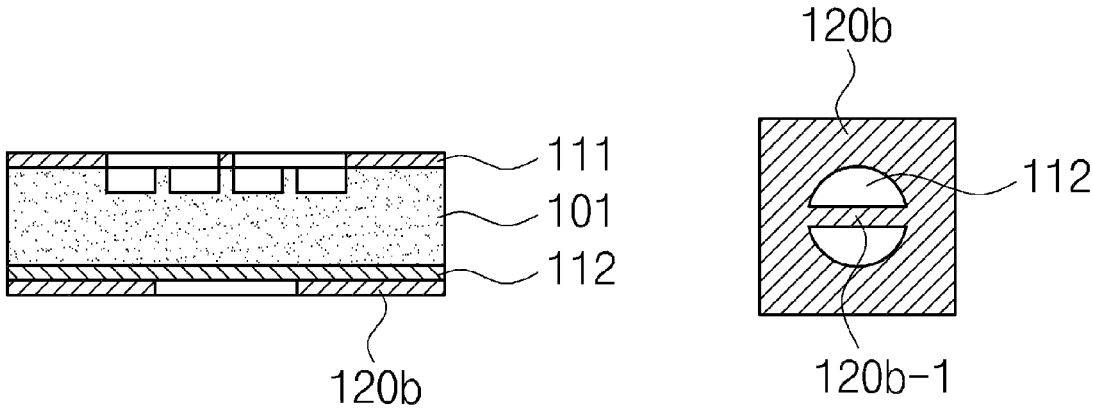
Figure 4B:
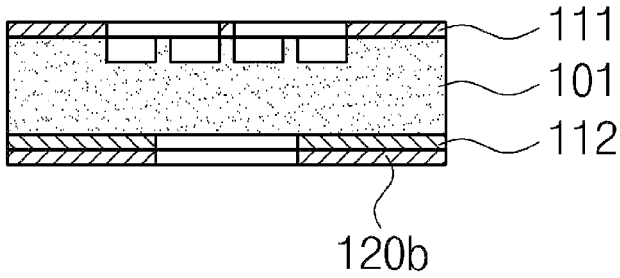
Figure 4C:
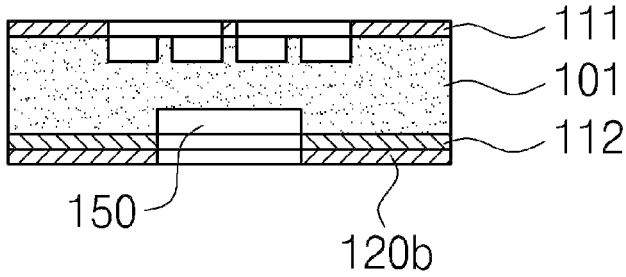

The process of forming the ink inflow channel in the lower part of the first substrate in the lower electrode forming step is shown in FIGS. 4(*a*) to 4(*c*).

First, a photosensitive polymer layer 120*b* such as a photoresistor layer is formed to a predetermined thickness on the bottom surface of the first substrate on which the oxide film 112 is formed and the ink inflow channel 150 and a support member of the pole-type lower electrode are patterned by using a photo engraving process (see FIG. 4(*a*)). On the right side of FIG. 4(*a*) shows a bottom view of the bottom surface of the first substrate in which the ink inflow channel 150 and the support member of the pole-type lower electrode are patterned (reference numeral 120*b*-1 represents the patterned part of the support member of the pole-type lower electrode). After then, by etching the oxide film 112 on the bottom surface of the first substrate and the substrate by using dry etching (see FIG. 4(*b*)), the ink inflow channel 150 and the support member of the pole-type lower electrode (not shown) are simultaneously formed (see FIG. 4(*c*)).

Figure 5A:
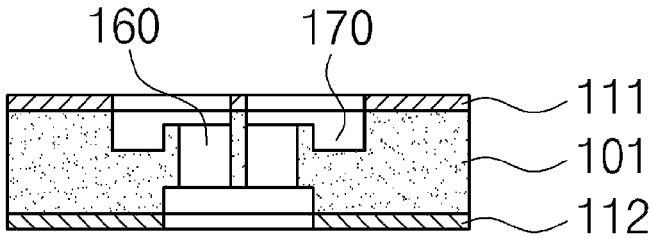
Figure 5B:
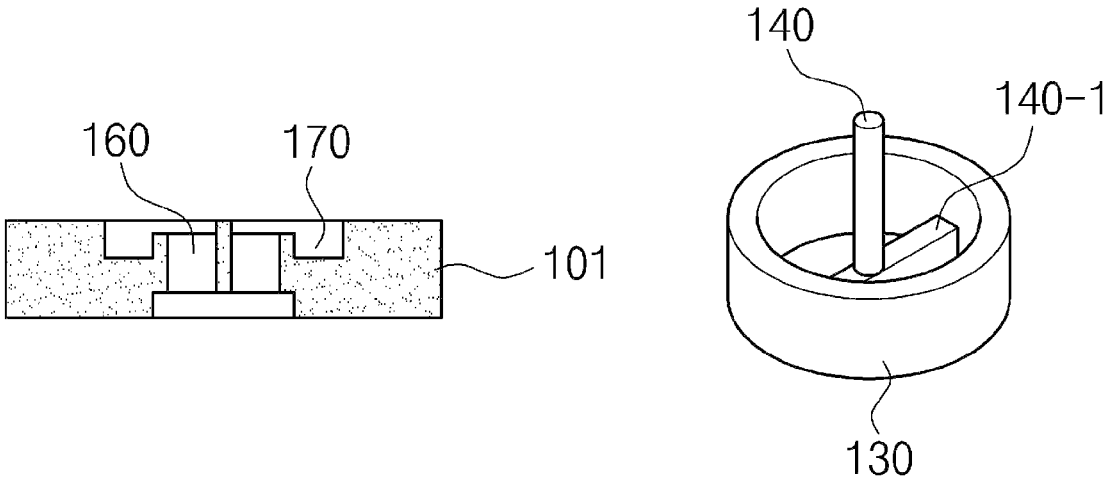
Figure 6A:
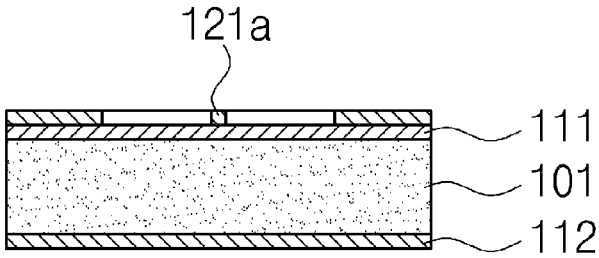
FIGS. 6 to 8 are cross-sectional views showing a forming process of a lower electrode unit in a manufacturing method of the droplet jetting apparatus using electrostatic force in accordance with another embodiment of the present invention.
Figure 6B:
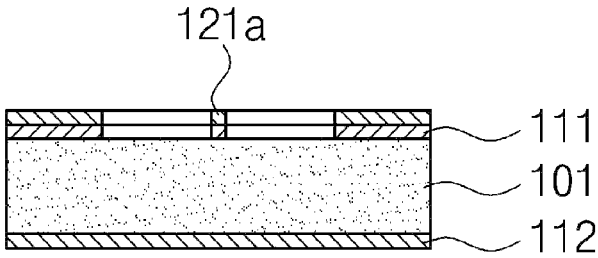
Figure 6C:
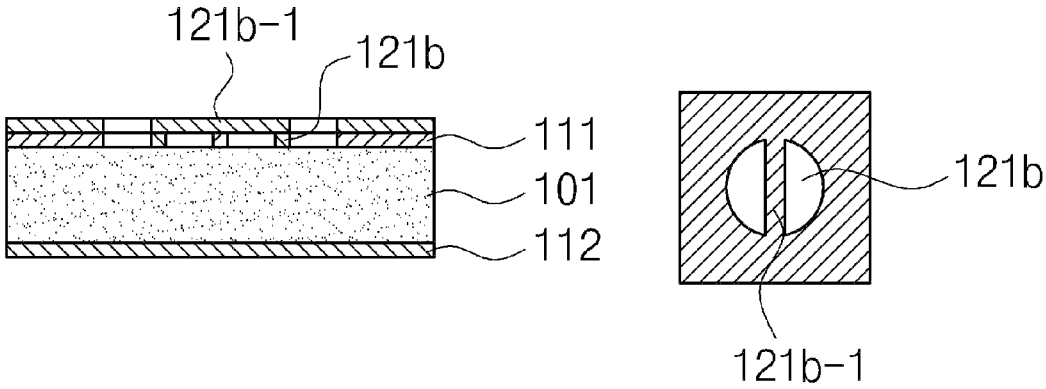
Figure 6D:
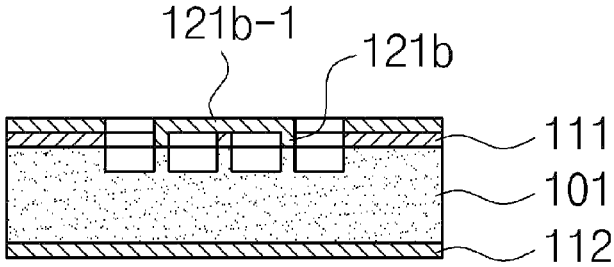

Next, FIGS. 5(*a*) and 5(*b*) show a process of forming the nozzle hole and the lower electrode higher than the nozzle in the lower electrode unit forming step.

When the formation of the ink inflow channel 150 in the lower part of the first substrate is completed, the upper part of the first substrate is dry-etched. Accordingly, the nozzle 130 in the upper part of the first substrate and the internal and external substrate sections of the nozzle which correspond to a part where the oxide film 111 is not grown, are etched (see FIG. 5(*a*)). As a result, the nozzle hole 160 and the pole-type lower electrode 140 higher than the nozzle are simultaneously formed (see FIG. 5(*b*)). On the right side of FIG. 5(*b*) shows the nozzle 130, the lower electrode 140 and the support member 140-1 of the lower electrode.

The step of forming the lower electrode unit in accordance with a second embodiment of the present invention will be described with reference to FIGS. 6 to 8.

FIGS. 6(*a*) to 6(*d*) show the process of forming the nozzle and the pole-type lower electrode in the upper part of the first substrate in the lower electrode unit forming step.

First, after a photosensitive polymer layer 121*a* such as a photoresistor layer is formed to a predetermined thickness in the central part of the top surface of the first substrate 101 on which oxide films 111 and 112 are formed by the use of semiconductor processing equipments, the pole-type lower electrode 140 is patterned by using a photo engraving process (see FIG. 6(*a*)). The oxide film 111 formed on the top surface of the first substrate is etched by wet etching or dry etching (see FIG. 6(*b*)).

After then, a photosensitive polymer layer 121*b* such as a photoresistor layer is formed to a predetermined thickness in the part where the oxide film on the top surface of the first substrate is removed and the nozzle and the support member of the pole-type lower electrode is patterned by using a photo engraving process. (see FIG. 6(*c*)). On the right side of FIG. 6(*c*) shows a plan view of the top surface of the first substrate in which the nozzle and the support member of the pole-type lower electrode are patterned (reference numeral 121*b*-1 represents the patterned part of the support member of the pole-type lower electrode and reference numeral 121*b* represents the patterned part of the nozzle). The nozzle 130 and the support member of the pole-type lower electrode (not shown) are simultaneously formed by etching the upper part of the first substrate by dry etching (see FIG. 6(*d*)).

Figure 7A:
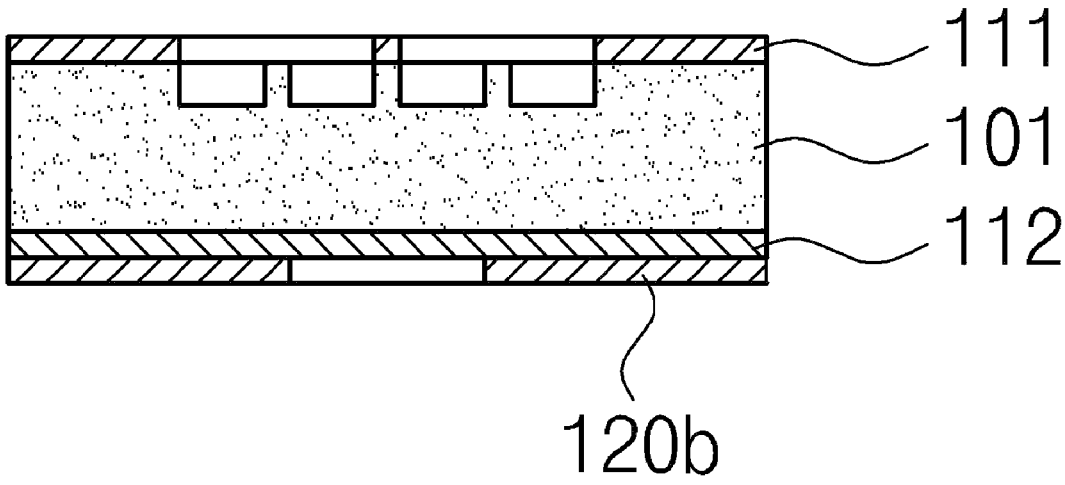
Figure 7B:
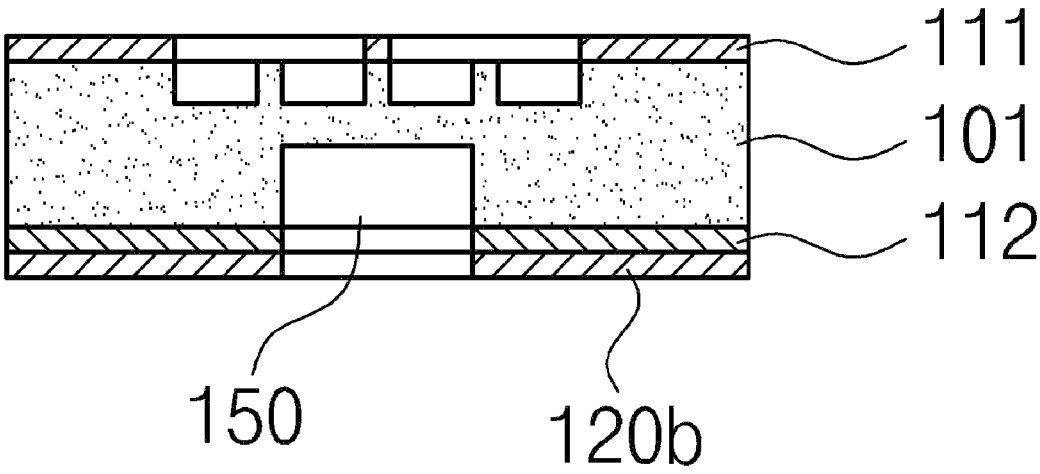

The process of forming the ink inflow channel in the lower part of the first substrate in the lower electrode forming step in accordance with the second embodiment of the present invention is shown in FIGS. 7(*a*) and 7(*b*).

First, a photosensitive polymer layer 120*b* such as a photoresistor layer is formed to a predetermined thickness on the bottom surface of the first substrate on which the oxide film 112 is formed and the ink inflow channel 150 is patterned by a photo engraving process (see FIG. 7(*a*)). After then, the oxide film 112 on the bottom surface of the first substrate is etched by using dry etching and the ink inflow channel is formed by drying etching or wet etching (see FIG. 7(*b*)).

Figure 8A:
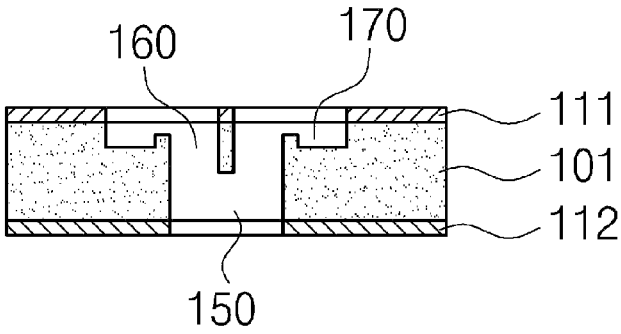
Figure 8B:
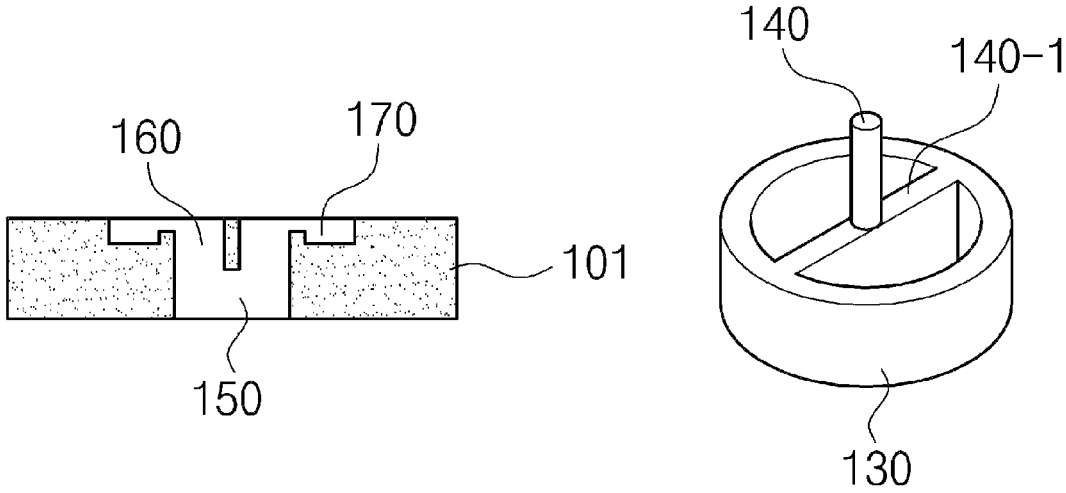
Figure 8C:
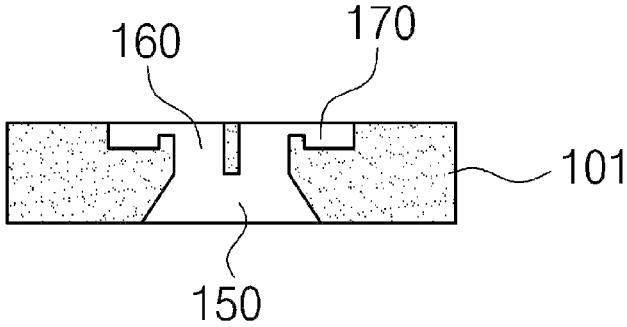

Next, FIGS. 8(*a*) and 8(*b*) show a process of forming the nozzle hole and the lower electrode higher than the nozzle in the lower electrode unit forming step.

When the formation of the ink inflow channel 150 in the lower part of the first substrate is completed, the upper part of the first substrate is dry-etched. Accordingly, the nozzle 130 in the upper part of the first substrate, the support member of the lower electrode in the nozzle, and the internal and external substrate sections of the nozzle which correspond to a part where the oxide film 111 is not grown, are etched (see FIG. 8(*a*)). As a result, the nozzle hole 160 and the pole-type lower electrode 140 higher than the nozzle are simultaneously formed (see FIG. 8(*b*)). On the right side of FIG. 8(*b*) shows the nozzle 130, the lower electrode 140 and the support member 140-1 of the lower electrode.

In a structure in which the support member of the pole-type lower electrode is formed not in the lower part but in the upper part of the first substrate, the ink inflow channel 150 formed in the lower part of the substrate may be enlarged by using wet etching or dry etching (see FIG. 8(*c*)).

Additionally, the lower electrode unit forming step of the present invention may further include a process of sharpening the end of the pole-type lower electrode formed in the upper part of the first substrate by using dry etching or wet etching so as to improve the concentration efficiency of the electrostatic force.

Figure 9A:
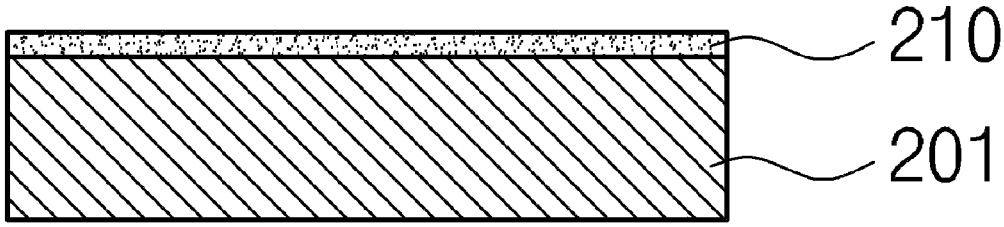
FIG. 9 is a cross-sectional view illustrating a forming process of an upper electrode unit in the manufacturing method of the droplet jetting apparatus using electrostatic force in accordance with the present invention.
Figure 9B:
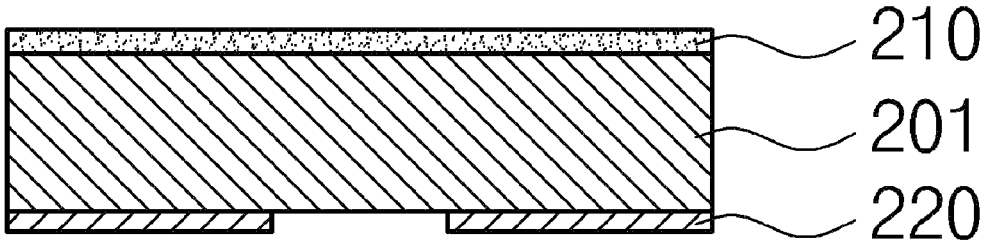
Figure 9C:
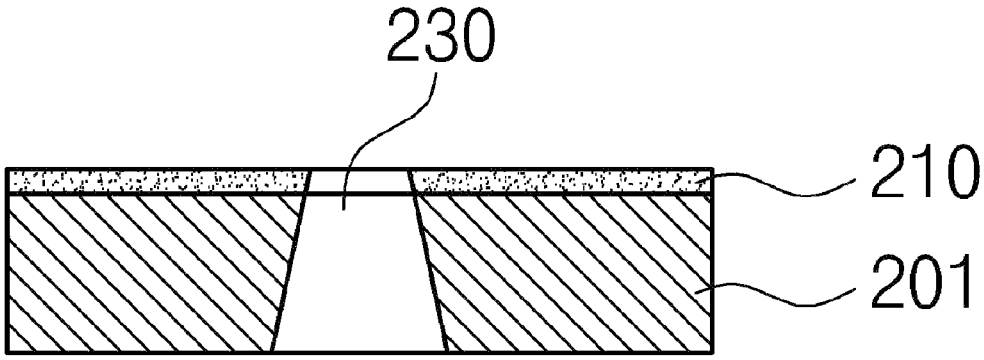
Figure 10:
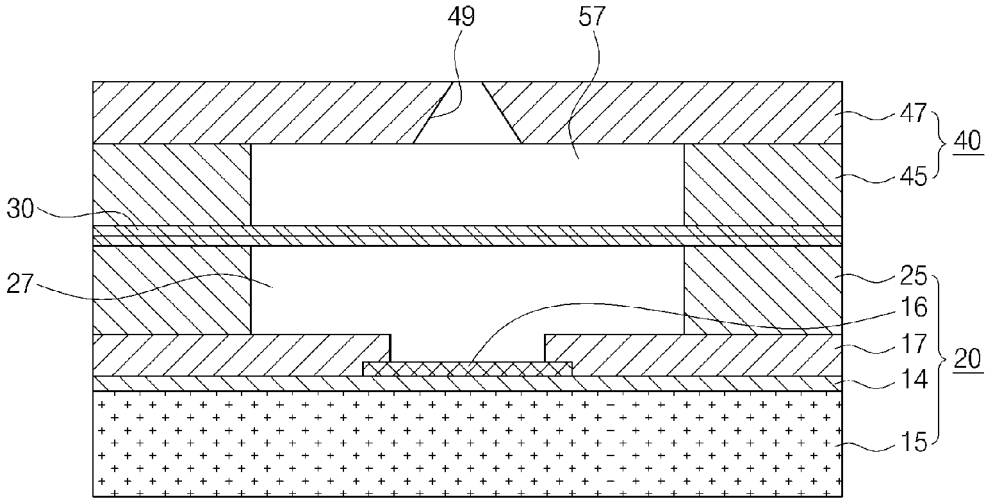
FIG. 10 PRIOR ART
FIG. 10 is a cross-sectional view of a conventional droplet jetting apparatus of thermal compress type.

A process of forming the upper electrode and ink discharge hole in the upper electrode unit forming step of the present invention is shown in FIGS. 9(*a*) to 9(*c*).

First, the upper electrode 210 is formed by depositing a metallic film on the top surface of the second substrate 201 by using a semiconductor thin-film deposition process (see FIG. 9(*a*)). A photosensitive polymer layer 220 is formed to a predetermined thickness on the bottom surface of the second substrate by spin coating and the ink discharge hole is patterned by a photo engraving process. Next, the ink discharge hole 230 is formed by etching the substrate from the bottom surface to the top surface of the second substrate by wet etching or dry etching (see FIG. 9(*c*)).

The upper electrode unit 200 forming step may further include a step of increasing the adhesive force of the metallic film deposited on the second substrate and the substrate by additionally performing a thermal treatment process after forming the upper electrode 210.

The second substrate 201 in which the upper electrode unit 200 is formed may be a glass wafer. In this case, the upper electrode and the ink discharge hole may be formed by a sand blaster process in the upper electrode unit forming step.

The manufacturing of the droplet jetting apparatus is completed by bonding the lower electrode unit 100 and the upper electrode unit 200 formed by the above-mentioned configuration with each other by using semiconductor bonding technology. At this time, the bonding layer 300 has a thickness that makes the gap between the lower electrode 140 and the upper electrode 210 suitable for discharging the ink by the electrostatic force generated between the lower and upper electrodes 140 and 210. The lower electrode unit 100 and the upper electrode unit 200 are bonded with each other so that the nozzle 130 of the lower electrode unit and the ink discharge hole 230 are vertically aligned.

When a predetermined voltage is applied to the upper electrode and the lower electrode manufactured by the above-mentioned configuration, the electrostatic force generated by the potential difference between the upper and lower electrodes acts on the ink, a meniscus is formed on the end of the nozzle and micro drops of ink are discharged through the ink discharge hole of the upper electrode.

In accordance with the above-mentioned droplet jetting apparatus, manufacturing method and ink providing method thereof of the present invention, since the ink nozzle and the pole-type lower electrode are integrally formed on the semiconductor substrate, and a membrane and an ink chamber barrier are not required, the structure of the droplet jetting apparatus is simple, allowing easy manufacturing, and the droplet jetting apparatus can be rapidly activated. Nozzle holes and pole-type electrodes of various sizes can be easily formed through a mask design, high integration can be achieved, and a quantity of and a speed of discharged ink can be controlled by adjusting applied power.

The present invention has been described with respect to certain preferred embodiments as described above. However, the present invention is not limited to the preferred embodiments and it will be apparent to those skilled in the art that various changes and modifications may be made without departing from the scope of the invention as defined in the following claims.

In accordance with the droplet jetting apparatus and the manufacturing method thereof of the present invention, since an upper electrode and a pole-type lower electrode for generating electrostatic force are formed on a semiconductor substrate integrally with the nozzle, and a membrane and an ink chamber barrier are not required, the structure is simple, allowing high integration and the droplet jetting apparatus can be easily manufactured.

Also, in accordance with the ink providing method of the droplet jetting apparatus of the present invention, the quantity and the speed of discharged ink can be controlled by properly adjusting applied power, and adjusting diameters of the nozzle hole and the pole-type lower electrode arbitrarily through a mask design, and micro drops of ink can be discharged.

What is claimed is:

1. A droplet jetting apparatus using electrostatic force, comprising:

a lower electrode unit in which a nozzle and a pole-type lower electrode positioned in the nozzle equipped in the upper part of a first substrate and an ink inflow channel equipped in the lower part of the first substrate and having a support member of the pole-type lower electrode therein are integrally formed;

an upper electrode unit having an upper electrode formed on the top surface of a second substrate and an ink discharge hole formed by being penetrated to the upper electrode from the bottom surface of the second substrate; and a bonding layer for bonding the lower electrode unit and the upper electrode unit with each other so that the nozzle is vertically aligned with the ink discharge hole, when the electrostatic force generated by the potential difference between the lower electrode and the upper electrode is applied to ink supplied to the nozzle through the ink inflow channel, a meniscus being formed on the end of the nozzle and micro drops of ink being discharged from the edge of the meniscus through the ink discharge hole of the upper electrode unit.

2. The droplet jetting apparatus using electrostatic force according to claim 1, wherein the nozzle of the lower electrode unit is formed on the first substrate in a cylindrical shape of a predetermined height with a nozzle hole.

3. The droplet jetting apparatus using electrostatic force according to claim 1, wherein the pole-type electrode of the lower electrode unit is formed higher than the nozzle.

4. The droplet jetting apparatus using electrostatic force according to claim 2, wherein the nozzle hole penetrates vertically to the end of the nozzle from the ink inflow channel.

5. The droplet jetting apparatus using electrostatic force according to claim 3, wherein the end of the pole-type lower electrode is formed in an acuminate shape.

6. An ink jetting method of a droplet jetting apparatus using electrostatic force, wherein the droplet jetting apparatus includes a lower electrode unit in which a nozzle and a pole-type lower electrode positioned in the nozzle equipped in the upper part of a first substrate and vertically communicated with an ink inflow channel from the bottom surface to the top surface of the first substrate and the ink inflow channel equipped in the lower part of the first substrate and having a support member of the pole-type lower electrode therein are integrally formed, an upper electrode unit having an upper electrode formed on the top surface of a second substrate and an ink discharge hole penetrating to the upper electrode from the bottom surface of the second substrate, and a bonding layer for bonding the lower electrode unit and the upper electrode unit with each other so that the nozzle is vertically aligned with the ink discharge hole, wherein the intensity of the electrostatic force generated by the potential difference between the lower electrode and the upper electrode is controlled by adjusting power applied from a power supply source connected to the lower electrode unit and the upper electrode unit, thereby adjusting a size and a discharge speed of an ink droplet supplied from the end of the nozzle.

* * * * *